United States Patent [19]

Nishikawa et al.

[11] 4,138,652

[45] Feb. 6, 1979

[54] DIELECTRIC RESONATOR CAPABLE OF SUPPRESSING SPURIOUS MODE

[75] Inventors: Toshio Nishikawa, Nagaokakyo; Youhei Ishikawa; Sadahiro Tamura, both of Kyoto, all of Japan

[73] Assignee: Murata Manufacturing Co., Ltd., Nagaokakyo, Japan

[21] Appl. No.: 797,857

[22] Filed: May 17, 1977

[30] Foreign Application Priority Data

May 24, 1976 [JP] Japan ..... 51/66657[U]

[51] Int. Cl.[2] ..... H01P 1/16; H01P 7/00

[52] U.S. Cl. ..... 333/82 R; 333/98 M

[58] Field of Search ..... 333/73 R, 73 W, 81 R, 333/82 R, 98 M

[56] References Cited

U.S. PATENT DOCUMENTS 3,475,642 10/1969 Karp et al. ..... 333/73 R 4,028,652 6/1977 Wakino et al. ..... 333/73 W

*Primary Examiner*—Paul L. Gensler

*Attorney, Agent, or Firm*—Wenderoth, Lind & Ponack

[57] ABSTRACT

The present disclosure relates to a dielectric resonator for use in microwave filters and other devices for receiving microwave. The arrangement of the present disclosure comprises a resonator made of a dielectric material of any known type and a bar member provided approximately in alignment with the direction of formation of the electric field produced by the propagation of a spurious mode in the dielectric resonator. During the propagation of the dominant mode accompanied by the spurious mode, the electric field produced by the spurious mode causes the bar member to produce a current flowing therethrough, thus consuming the energy of the spurious mode in the bar member, and substantially eliminating the spurious mode.

6 Claims, 12 Drawing Figures

DIELECTRIC RESONATOR CAPABLE OF SUPPRESSING SPURIOUS MODE

The present invention relates to a dielectric resonator and, more particularly, to a dielectric resonator for use in a microwave filter for spurious suppression.

It is well known that a microwave band-pass filter utilizes one or more resonators made of dielectric material. Conventionally, in the manufacture of a filter employing a dielectric resonator, the undesirable spurious mode is suppressed by making a relatively great difference between the resonance frequency of the high or spurious mode and that of the fundamental or dominant mode. In order to achieve this, various methods have heretofore been employed, one method of which is to appropriately select the ratio between the diameter and height of the resonator employed and another method is to reduce, by any means, the value of quality factor Q for the high mode or resonance frequencies so that the undesirable spurious modes can be reduced.

However, it has been found that the first mentioned method is merely successful in making the ratio of the resonance frequency at the dominant mode relative to the resonance frequency of the high or spurious mode about 1.3 which is not satisfactory in respect to the reduction in the spurious mode characteristics. On the other hand, it has also been found that the second mentioned method can only be carried out, using the conventional method, with difficulty because it is difficult to reduce only the value of the quality factor Q for the spurious mode without an accompanying reduction of the value of the quality factor Q for the dominant mode.

Accordingly, it is a primary object of the present invention to provide an improved dielectric resonator which, when used in a microwave filter, is capable of reducing or eliminating the quality factor Q of the spurious mode having a resonance frequency close to that of the dominant mode without causing any deterioration in the quality factor Q of the dominant mode, thus substantially eliminating the spurious mode.

It is another object of the present invention to provide an improved dielectric resonator of the above described type in which the elimination of the spurious mode can be effected through a simple construction.

In order to accomplish these and other objects, according to the present invention, there is employed a dielectric resonator which comprises a block of known dielectric material and at least one bar member made of conductive material provided approximately in alignment with the direction of the electric field produced by the propagation of the spurious mode in the dielectric resonator.

During the propagation of the dominant mode accompanied by the spurious mode, the direction of the formation of the electric field produced by the dominant mode is at right angles to that produced by the spurious mode. Accordingly, the electric field produced by the spurious mode causes a current to flow through the bar member, while the electric field produced by the dominant mode scarcely affects the bar member. The energy of the spurious mode is substantially consumed in the bar member, and thus, the spurious mode is eliminated.

These and other objects and features of the present invention will become apparent from the following descriptions made in conjunction with preferred embodiments thereof with reference to the accompanying drawings, in which.

Figure 6A:
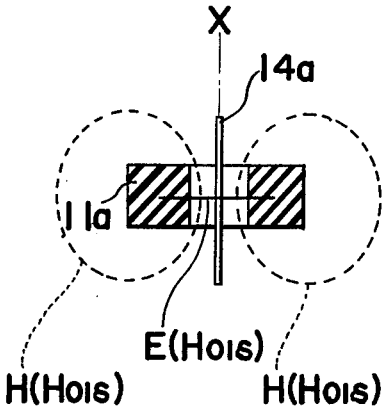
Figure 7:
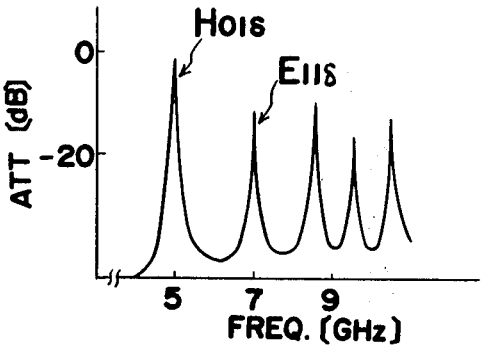
Figure 7:
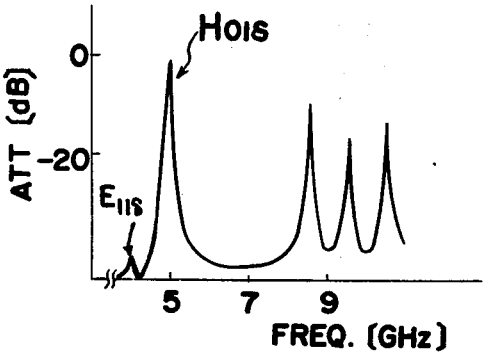
Figure 8:
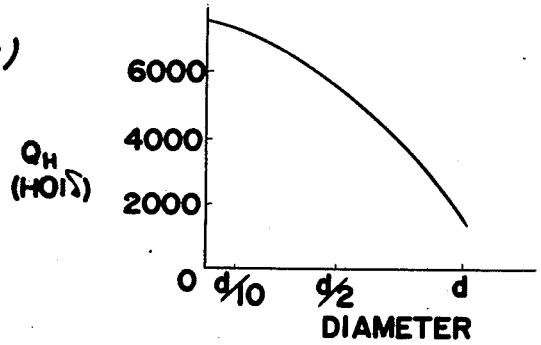
Figure 8:
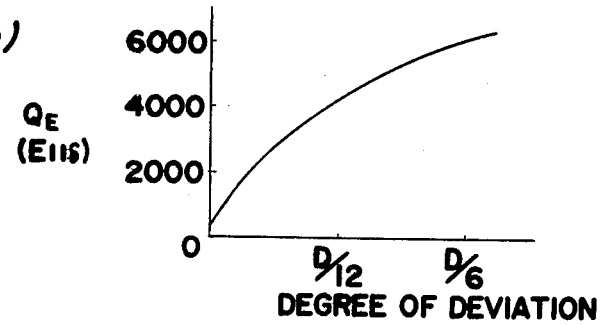
Figure 8:
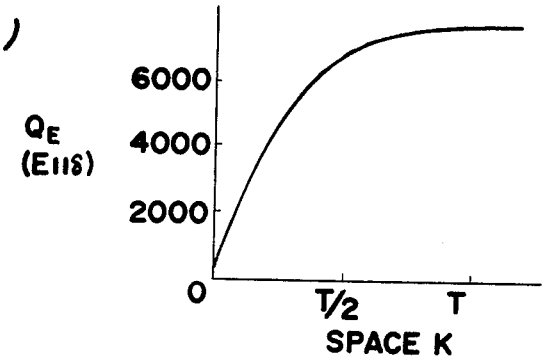

FIGS. 6(*a*) and 6(*b*) are fragmentary sectional views of the dielectric resonator of the present invention, particularly showing the representation of the electric field and the magnetic field therearound;

FIGS. 7(*a*) and 7(*b*) are graphs particularly showing the frequency characteristics of the resonator, with and without the bar member, respectively;

FIG. 8(*a*) is a graph particularly showing the relation between the diameter of the bar member and the quality factor Q of the dominant mode;

FIG. 8(*b*) is a graph particularly showing the relation between the degree of displacement of the bar member and the quality factor Q of the spurious mode; and FIG. 8(*c*) is a graph particularly showing the relation between a space formed between the bar member and the resonator and the quality factor Q of the spurious mode.

Before the description of the present invention proceeds, it should be noted that like parts are designated by like reference numerals throughout the accompanying drawings.

Figure 1:
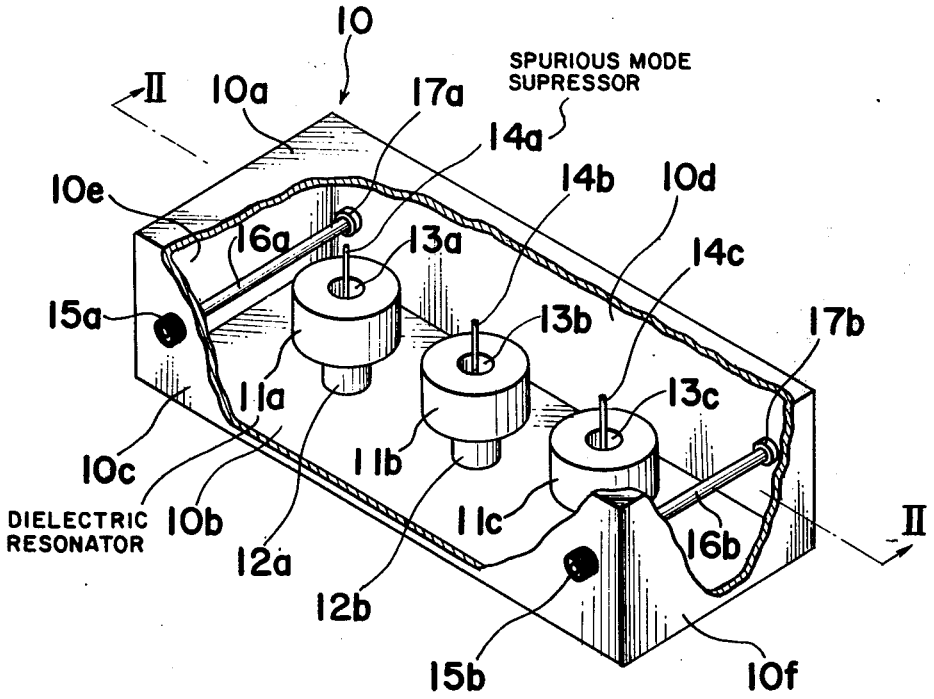
FIG. 1 is a perspective view of a band-pass filter partly broken to show the arrangement of the dielectric resonator of the present invention.

Referring first to FIG. 1, a microwave band-pass filter shown comprises a casing 10 of substantially box-like configuration, made of any known metallic material such as brass, which casing 10 includes top and bottom coverings 10*a* and 10*b*, a pair of opposed side walls 10*c* and 10*d* and a pair of end walls 10*e* and 10*f*. Although the walls 10*a* to 10*f* are shown as integrally formed together by machining a rigid metal block, the walls may be formed by metallic plates, with the neighboring walls being rigidly connected to each other, by the use of, for example, a set of screws.

Within the casing 10, one or more resonators, three are illustrated in FIG. 1 and indicated by 11*a*, 11*b*, and 11*c*, are mounted on the bottom covering 10*b* through respective supporting spacers 12*a*, 12*b* and 12*c* and arranged in a spaced side-by-side relation with respect to each other. The supporting spacers 12*a* to 12*c* are made of any known electrically insulating material having a relatively low dielectric constant. The three cylindrical resonators 11*a*, 11*b* and 11*c* are formed therein with through holes, namely apertures 13*a*, 13*b* and 13*c*, respectively. The bar members 14*a*, 14*b* and 14*c* are made of highly conductive material or conductive material having a certain degree of resistance. The bar members 14*a*, 14*b* and 14*c* are placed in the apertures 13*a*, 13*b* and 13*c*, respectively in alignment with the axis of the aperture. The relation between the cylindrical resonators and the bar members are described in detail later, however, in the meantime, further structure of the casing 10 as well as a method of mounting the resonators 11*a* to 11*c* to the bottom covering 10*b* through the respective supporting spacers 12*a* to 12*c* will subsequently be described.

One of the opposed side walls 10*c* is provided at portions adjacent to the opposed ends of casing 10 with couplers 15*a* and 15*b* for respective connection with coaxial cables for microwave input and output transmission lines (not shown). These couplers 15*a* and 15*b* have axial terminals which are electrically insulated from the metal casing 10 and which are respectively connected to rods or probes 16*a* and 16*b* made of either electrically conductive material or dielectric material. The probes 16*a* and 16*b* in the instance shown in FIG. 1 extend in parallel relation to the end walls 10*e* and 10*f* and are between the end wall 10*e* and the end resonator 11*a* and between the end wall 10*f* and the end resonator 11*c* respectively. The opposed end of each of the probes 16*a* and 16*b*, which is remote from the corresponding coupler 15*a* or 15*b*, is supported by the opposed side wall 10*d* by means of a mounting piece 17*a* or 17*b* made of electrical insulating material such as polytetrafluoroethylene. The size of the casing 10, particularly the inner size thereof, is arranged to have a predetermined cutoff frequency.

Figure 2:
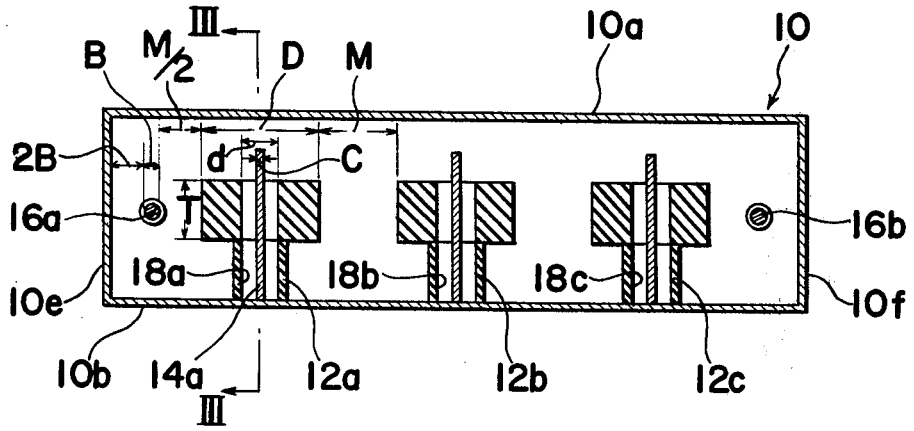
FIG. 2 is a sectional side view taken along the line II—II of FIG. 1.
Figure 3:
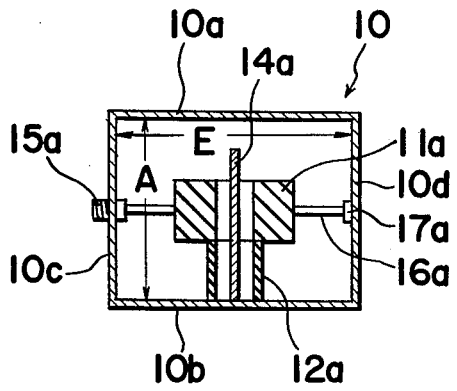
FIG. 3 is a sectional front view taken along the line III—III of FIG. 2.

With particular reference to FIGS. 2 and 3, there are shown details of the dielectric resonators 11*a*, 11*b* and 11*c* according to the present invention. The description hereinbelow is particularly directed to the first resonator 11*a* provided at the left side as viewed in FIG. 2, however, it is to be noted that other resonators 11*b* and 11*c* are formed in the same manner and have the same structure as the resonator 11*a*. The dielectric resonator 11*a* is made of a cylindrical block of any known dielectric material with the aperture 13*a* coaxially formed therein. The size of cylindrical block is such that the diameter D thereof is a few centimeters, for example, in one type 1.45 cm, the thickness T thereof is about half the size of the diameter D and is determined by the resonating frequency, and the diameter d of the aperture 13*a* is approximately $\frac{1}{3}$ of the diameter D. This resonator as described above is fixedly bonded to the cylindrical supporting spacer 12*a* which is in turn fixedly bonded to the bottom covering 10*b*. As is apparent from FIG. 2, the cylindrical supporting spacer 12*a*, as well as other spacers 12*b* and 12*c*, has an aperture 18*a* which is in alignment with the aperture 13*a* formed in the resonator 11*a*. Bar member 14*a* is provided through the apertures 13*a* and 18*a* and extends in a direction in alignment with the axis of the apertures 13*a* and 18*a* in a spaced relation from the inner surface of the apertures 13*a* and 18*a*. The diameter of the bar member 14*a* has a smaller diameter than the diameter d of the aperture 13*a*, for example, d/10. The bar member, in this preferred embodiment shown in FIGS. 1 to 3 has one end fixedly connected to the bottom covering 10*b* in such a manner as to pass through the center of the resonator 11*a* and the supporting spacer 12*a* while the other end is extended adjacent to the top covering 10*a*. In alternative embodiments, the bar member may be fixedly connected to the top covering 10*a* while the other end is extended adjacent to the bottom covering 10*b*, or opposite ends of the bar member may be fixedly connected to the top and bottom coverings, respectively. The connection between the bar member and the respective covering may be carried out by direct connection, for example, by soldering or using screws for effecting electrical connection between the bar member and the respective covering or, may be made by indirect connection through any known insulating material such as polyfluoroethylene for electrically insulating the bar member from the casing 10.

It is to be noted that such aperture 18*a* as described above is provided for easy placing of the bar member 14*a*, and also, for improving the temperature-dielectric characteristics of the resonator. The height of the supporting spacer 12*a* is such that the center of the resonator 11*a* bonded onto the spacer 12*a* matches the center of the depth A of the casing 10. The inner dimensions of the casing 10 are such that the depth A is arranged within a range of 2T to 3T, while the width E, corresponding to the length of the probes 16*a* and 16*b*, is selected within a range of 2D to 3D. The distance measured along the longitudinal direction of the casing 10 is determined by the number of the resonators to be placed in the casing 10.

Still referring to FIG. 2, the three resonators 11*a*, 11*b* and 11*c* are spaced apart from each other a distance M which is normally selected within a range of D/2 to D, while the distance between the resonator 11*a* and the probe 16*a* and the distance between the resonator 11*c* and the probe 16*b* are both selected to be M/2. Each of the probes 16*a* and 16*b* is spaced apart from the end walls 10*e* and 10*f*, respectively, at a distance arranged within a range of B to 3B in which B is a diameter of the probe. It is to be noted that the axis of the probes 16*a* and 16*b* are in alignment with the center of the resonators.

When the microwave filter is constructed with the use of dielectric resonators 11*a*, 11*b* and 11*c* having the bar members 14*a*, 14*b* and 14*c* as described above, the dominant mode of resonance is $H_{01\delta}$ while the resonating frequency, according to the embodiment of the present invention, is 5 GHz. It is to be noted that the dominant mode as well as the resonating frequency may be changed, with respect to the change of size of the casing 10 and each of the resonators.

Referring to FIGS. 7(*a*) and 7(*b*), there are shown frequency characteristics of the resonator, in which the abscissa represents frequency and the ordinate represents attenuation. The curve illustrated in FIG. 7(*a*) is obtained when the resonator is not provided with the bar member, while the curve illustrated in FIG. 7(*b*) is obtained when the resonator is provided with the bar member. Generally, when the signal has wide range of frequencies in the GHz range, spurious modes having frequencies below the cutoff frequency are favorably cutoff by the filter. In contrast the spurious modes having frequencies above the cutoff frequency are undesirably propagated through the resonator as illustrated by the peaks substantially appearing after the dominant mode $H_{01\delta}$. Although it is possible to eliminate the spurious modes appearing in comparatively high frequency range by the employment of a suitable low-pass filter, it is difficult to eliminate, by the filter, the spurious mode, such as the spurious mode $E_{11\delta}$, having a frequency closest to the resonating frequency of the dominant mode $H_{01\delta}$, because that filter may deteriorate the quality factor of the dominant mode $H_{01\delta}$. However, according to the resonator of the present invention, the bar member provided in the resonator will eliminate the spurious mode neighboring the dominant mode as illustrated in the graph shown in FIG. 7(*b*). The manner in which the spurious mode $E_{11\delta}$ is eliminated is described hereinbelow in connection with FIGS. 6(*a*) and 6(*b*).

Figure 6B:
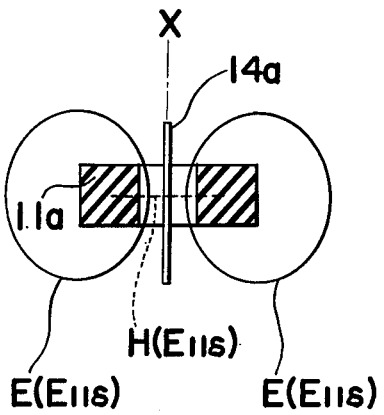

Referring particularly to FIG. 6(*a*), there is shown a representation of the electric field $E(H_{01\delta})$ and the magnetic field $H(H_{01\delta})$ which are produced by the dominant mode $H_{01\delta}$ propagating in the resonator. As is apparent to those skilled in the art, the propagation of the dominant mode $H_{01\delta}$ in the resonator causes the magnetic field $H(H_{01\delta})$ to be produced around the resonator in a direction to traverse the central portion of the resonator and in a parallel relation to the axis X of the resonator, as shown by the dotted line, while the electric field $E(H_{01\delta})$ is caused to be produced, as shown by the solid line, inside the resonator and in linked relation with the magnetic field $H(H_{01\delta})$, as shown by the real line. Accordingly, a current is not likely to be produced along the rod member 14a. However, when the spurious mode $E_{11\delta}$ is propagated in the resonator, the representation of the electric field and the magnetic field result in the opposite relation to the previously described relation, as is described hereinbelow in connection with FIG. 6(b).

Referring particularly to FIG. 6(b), there is shown a representation of the electric field $E(E_{11\delta})$ and the magnetic field $H(E_{11\delta})$ which are produced by the spurious mode $E_{11\delta}$ propagating in the resonator. As is also apparent to those skilled in the art, the propagation of the spurious mode $E_{11\delta}$ in the resonator produces the electric field $E(E_{11\delta})$ around the resonator in a direction to traverse the central portion of the resonator and in a parallel relation to the axis X of the resonator, as shown by the solid line, while the same causes the magnetic field $H(E_{11\delta})$ to be produced inside the resonator and in linked relation with the electric field $E(E_{11\delta})$, as shown by the dotted line. Accordingly, due to the magnetic field produced around the axis X and substantially around the bar member 14a or the electric field produced in alignment with bar member 14a, a current is likely to be produced through the bar member 14a. Thus, the energy of the spurious mode is consumed therein substantially eliminating the spurious mode $E_{11\delta}$.

It is to be noted that the bar members 14b and 14c provided in other resonators 11b and 11c will function in the same manner as the bar member 14a described above, and also that the bar members 14a, 14b and 14c not only affect the spurious mode $E_{11\delta}$, but also affect other undesirable modes producing a magnetic field around the bar member.

It is to be noted that the diameter of the bar member described as being 1/10 of the diameter d, may further be modified to have a larger or smaller size yet obtain the same effect. The larger diameters of the bar member, however, may result in a decrease of the quality factor $Q_H$ of the resonator in the dominant mode $H_{01\delta}$.

Referring to FIG. 8(a), there is shown the relation between the diameter of the bar member and the quality factor $Q_H$ of the resonator. As is apparent from the graph, the quality factor $Q_H$ decreases as the diameter of the bar member increases. The size d/10 is the size temporarily defined for facilitating the construction of the microwave band-pass filter and yet maintaining comparatively high quality factor. In cases where there is a requirement for a higher quality factor $Q_H$, a bar member may be selected having a smaller diameter, upon employment of a highly conductive material, such as gold.

Figure 5:
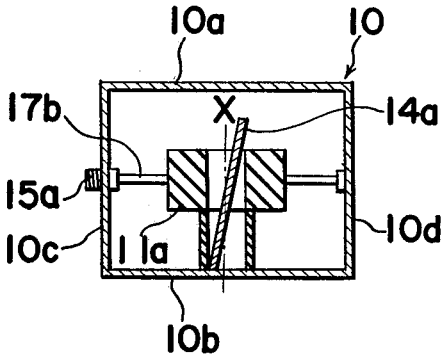

It is also to be noted that the bar member described as at the center of the resonator and aligned with the axis of the resonator, may be in a tilted relation to the axis, as shown in FIG. 5, or may deviate from the center of the resonator.

Referring to FIG. 8(b), there is shown the relation between the degree of the deviation of the bar member and the quality factor $Q_E$ of the resonator in the spurious mode $E_{11\delta}$. As is apparent from the graph, the quality factor $Q_E$ of the resonator in the spurious mode $E_{11\delta}$ increases as the degree of deviation of the bar member increases from the center of the resonator towards any surface of the aperture 13a. Therefore, as the bar member moves towards the surface of the aperture, the amplitude of the remaining spurious mode increases.

Figure 4:
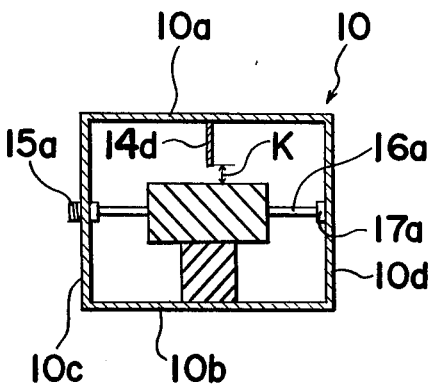
FIGS. 4 and 5 are similar views to FIG. 3, but particularly show the modification thereof.

It is further to be noted that the bar member, described as penetrating through the resonator may be modified to be adjacent to a resonator of a solid block type, as shown in FIG. 4. According to the type shown in FIG. 4, it is preferable to provide the bar member 14d closely adjacent to or in contact with the upper surface of the solid resonator. However, it is still possible to attenuate the spurious mode even if the bar member 14d is spaced apart from the resonator, although some degree of the spurious mode may remain.

Referring to FIG. 8(c), there is shown the relation between the distance K between the tip of the bar member 14d and the upper surface of the resonator and the quality factor $Q_E$ of the resonator in the spurious mode $E_{11\delta}$. As is apparent from the graph, the quality factor $Q_E$ of the resonator in the spurious mode $E_{11\delta}$ increases with increasing distance K between the tip of the bar member 14d and the upper surface of the resonator. Therefore, as the bar member 14d becomes shorter, the amplitude of the remaining spurious mode increases.

Although the present invention has been fully described by way of example in connection with the preferred embodiments thereof, it should be noted that various changes and modifications are apparent to those skilled in the art. By way of example, the resonator according to the present invention can be used not only in the microwave band-pass filter referred to above, but also in other microwave filters such as microstrip filters and waveguide filters which employ the dielectric resonators therein. In addition, even in the embodiments shown in FIGS. 2 and 4, the dielectric resonator may be modified to have one or more additional apertures other than the aperture such as indicated by 13a with bar members provided therein. Furthermore, the dielectric resonator may be so altered as to have one or more additional bar members other than those indicated by 14a to 14d for each of the resonator.

Therefore, these changes and modifications are to be understood as included within the scope of the present invention unless they depart therefrom.

What is claimed is:

1. A dielectric resonator for suppressing spurious modes comprising:

a cylindrical block of dielectric material having flat surfaces on the ends thereof; and at least one straight, thin, electrically conducting bar member provided approximately in alignment with the axis of said cylindrical block of dielectric material and approximately in alignment with the direction of the electric field produced by propagation of a spurious mode in said cylindrical block of dielectric material and said bar member being in other than a retaining relationship with said cylindrical block of dielectric material, whereby said electric field produced by the spurious mode produces a current in said bar member thereby consuming the energy of the spurious mode in the bar member for suppressing the spurious mode.

2. A dielectric resonator as claimed in claim 1, wherein said bar member is provided adjacent to one of said flat surfaces of said cylindrical block of dielectric material.

3. A dielectric resonator as claimed in claim 2, wherein the tip end of said bar member is spaced apart from said flat surface of said cylindrical block of dielectric material at a distance less than the thickness of said cylindrical block of dielectric material.

4. A dielectric resonator as claimed in claim 1, wherein said cylindrical block of dielectric material has at least one aperture formed therein in alignment with the direction of formation of said electric field of said spurious mode.

5. A dielectric resonator as claimed in claim 4, wherein said bar member is provided to pass through said aperture parallel to the axis of said aperture.

6. A dielectric resonator as claimed in claim 5, wherein said bar member has a diameter smaller than d/10, in which d is the diameter of said aperture.

* * * * *